US006571546B1

(12) United States Patent
Pickel et al.

(10) Patent No.: US 6,571,546 B1
(45) Date of Patent: Jun. 3, 2003

(54) DEVICE FOR PRODUCING COVERED YARN

(75) Inventors: Hermann Pickel, Schondra (DE); Günter Oppl, Hammelburg (DE); Günther Schmitt, Pfaffenhausen (DE)

(73) Assignee: Temco Textilmaschinenkomponenten GmbH & Co. KG, Hammelberg (DE)

( * ) Notice: Subject to any disclaimer, the term of this patent is extended or adjusted under 35 U.S.C. 154(b) by 0 days.

(21) Appl. No.: 09/581,274

(22) PCT Filed: Jan. 31, 2000

(86) PCT No.: PCT/EP00/00755

§ 371 (c)(1),
(2), (4) Date: Nov. 14, 2000

(87) PCT Pub. No.: WO00/46437

PCT Pub. Date: Aug. 10, 2000

(30) Foreign Application Priority Data

Feb. 1, 1999 (DE) ..... 199 03 797
May 31, 1999 (DE) ..... 199 24 883

(51) Int. Cl.[7] ..... D01H 1/42
(52) U.S. Cl. ..... 57/58.83; 57/58.52
(58) Field of Search ..... 57/58.52, 58.72, 57/58.76, 58.83, 58.84, 58.86

(56) References Cited

U.S. PATENT DOCUMENTS 3,398,518 A * 8/1968 Nimtz et al. ..... 57/75
4,494,369 A * 1/1985 Ramani ..... 57/76
5,515,671 A * 5/1996 Dur ..... 57/58.83

FOREIGN PATENT DOCUMENTS

| | | |
|---|---|---|
| DE | 2941160 A | 4/1981 |
| DE | 3033046 A | 4/1982 |
| DE | 3035008 A | 4/1982 |
| DE | 3105832 A1 | 9/1982 |
| DE | 19626549 A1 | 1/1998 |
| DE | 19626549 A | 8/1998 |
| FR | 1399026 | 4/1965 |
| GB | 1324206 | 7/1973 |

OTHER PUBLICATIONS

Search Report, EPO, 7 pages, Sep. 27, 2000.

* cited by examiner

*Primary Examiner*—Danny Worrell
(74) *Attorney, Agent, or Firm*—Dority & Manning, PA

(57) ABSTRACT

In a device for manufacturing covered yarn in which one or several threads (6) surround a yarn core in a helical fashion a rotating winding spindle is provided with a spool (5). The winding thread (6) is located on the spool (5). The winding spindle is surrounded by a stationary pot (8, 8*a*, 8*b*) that can be divided along a geneatrix, in particular in the axial direction of the pot (8, 8*a*, 8*b*). The parts of the pot (8, 8*a*, 8*b*) comprise a layer (30, 30*a*, 30*b*) that surrounds the spool (5) at least partially and is mechanically and/or thermally wear-resistant and/or exhibits low friction.

8 Claims, 2 Drawing Sheets

DEVICE FOR PRODUCING COVERED YARN

The present invention is relative to a device for manufacturing covered yarn in which one or several threads [yarns] are wound in a helical fashion around a yarn core. A rotating winding [respooling] spindle is provided with a spool [bobbin] on which the winding thread is located and with a fixed pot surrounding the winding spindle which pot can be divided along a geneatrix, especially in the axial direction of the pot.

DE 31 05 832 A1 describes a method and a device for manufacturing covered yarn. It discloses sheaths [jackets] which can be stationary or rotate at the same time and which are arranged around a system of hollow spindle and spool. Accordingly, the use of fiber-reinforced plastic can be provided for rotating sheaths. As a result of the rotating sheath of fiber-reinforced plastic the weight of this part is reduced, which makes possible a desirable, high spindle speed. The rotating sheath is fastened to the mounting of the hollow spindle and thus rotates together with the hollow spindle. It is therefore advantageous in this instance if a plastic is used as light material for the sheath in order to reduce the occurring centrifugal forces of the rotating parts. Nothing can be gathered concerning the material and the buildup in the case of a stationary sheath from the disclosure.

DE 196 26 549 A1 also shows a casing or a housing in a generic device which housing is arranged in a stationary manner and at an interval opposite the spool and surrounds at least the sheath surface of the spool. According to an especially advantageous embodiment the housing consists of two sheath [jacket] parts connected to each other in such a manner that they can pivot open and closed. The operation of such a device is particularly advantageous on account of the divided sheath since the spool is readily assessable when the winding thread has run out by opening the sheath and can be replaced with a full spool. The thread drawn off from the spool forms a balloon. This thread balloon is limited by the pot. In the case of rotating pots and quite particularly in the case of stationary pots surrounding the winding spindle the thread brushes along the inside of the pot while it is being drawn off, which produces a strain in particular on the closely adjacent pot. The pot wears down thereby, in particular at the high speeds of modem spinning winding machines. Current pots are either too cost-intensive in their manufacture or not sufficiently wear-resistant so that in some instances they must be replaced after a short operating time.

The invention therefore has the problem of creating a device, in particular a pot with which the above-cited disadvantages of a relatively rapid wear of the pot at the high speeds of modem spinning winding machines are eliminated and an effective energy savings during the operation of the spinning winding machine is achieved by the pot.

The invention is solved by a device with the features of claim 1. The friction of the winding thread, which brushes against the pot while it is being drawn off from the spool can be coordinated by a mechanically and/or thermally wear-resistant layer coordinated with the particular use. The pot, which functions as a balloon limiter for the thread, creates optimal frictional conditions for the thread with a mechanically and/or thermally wear-resistant layer. Moreover, in addition to the longer service life of the pot an even higher rotating speed of the winding spindles is possible in a particularly advantageous manner since the danger of a thread break can be distinctly limited by means of an appropriately adapted layer. Moreover, the layer also achieves in an especially advantageous manner an energy savings in comparison to traditional pots since the frictional conditions with the thread are optimized. The invention achieves particular advantages by virtue of the fact that the pot is designed to be stationary. In a stationary pot the drawing off of the winding thread can be distinctly improved by the appropriate layer or pot insert since in this instance the friction of the thread on the pot is particularly strong and therefore an adaptation of the frictional surface with an appropriate, wear-resistant and low-friction layer offers particular advantages.

If the pot consists of a base body and a mechanically and/or thermally wear-resistant layer surrounding the spool at least partially it is advantageously possible to adapt a pot optimally to the yarn to be processed as regards its mechanical and/or thermal properties and to use it. All that is necessary is to adapt a mechanically and/or thermally wear-resistant layer to the corresponding winding thread in order to obtain optimal wear results. The base body of the pot can be retained thereby. This creates a pot for various purposes which can be economically manufactured and, in particular, optimally designed. The base body with its fastening devices on the spinning winding device can be retained.

If the pot basically consists completely of the material of the mechanically and/or thermally wear-resistant and/or low-friction layer an especially simple embodiment of the invention is created. In the case of wear or damage to the layer the entire pot is replaced. On the other hand, the manufacture of the pot, especially if it is manufactured from a material which is easy to work such as, e.g., noble steel, is relatively economical.

It is advantageous if the layer is a pot insert arranged inside the pot on the base body. It is advantageous if the pot insert can be readily replaced. It can thus be replaced by a pot insert with a different layer for different purposes.

As a result of the ability of the pot to be divided along a geneatrix the spool can be replaced in a particularly simple manner when the winding thread has run out. As a result of the division of the pot the spool is more readily assessable so that it can be removed manually or automatically out of the device. If the division of the pot is arranged in the axial direction the complete spool is readily assessable by folding open the pot and can thus be replaced in a particularly simple manner.

In order to assure a reliable operation of the spinning winding device the divided pot can be closed with a hinge and a lock so that a simple operation and in particular a reliable operating position is assured as a result in that the divided pot can be reliably closed in order to avoid an unintentional opening of the pot during the spinning process.

In order to assure an especially simple operation of the device, that is, to be able to grasp the spool in a very simple manner and remove it from the spinning winding device and to be able to reinsert it, it is especially advantageous if the pot can be moved away on both sides of the spool. As a result of this opening of the device on both sides it is possible in a very simple manner to grasp and handle the spool since the pot has been removed sufficiently far from the spool and its winding plates. A stop is provided in order to assure a positionally exact closing of the pot. Both parts of the pot are moved against this stop and fastened in this position. The stop assures that the pot is arranged around the spool in a concentric manner when it is in closed position.

A stop is provided in an especially advantageous embodiment that functions as a stop with reference to the adjacent spindle. This reliably prevents the pot of this spinning location from striking against an adjacent spool or spindle and damaging it when a spinning location is opened. The stop functions here as a stop device when the pot of this winding spindle is. opened.

In an especially advantageous embodiment the stop for the concentric closing of the pot parts is identical to the stop for the adjacent pot. The stop has a double function here, namely, on the one hand the concentric closing of the one pot and on the other the protecting of this pot from being damaged by the adjacent pot. This danger of being damaged is especially present when the pot of the adjacent spinning location has been removed and an adjacent pot half might be able to strike against the spindle or spool.

If a seal is provided between the parts of the pot that is active when the pot is closed, an advantageous flow is produced inside the pot and foreign air is prevented from flowing in. The thread running off of the spool inside the pot is guided thereby in a protective manner and without disturbing influences inside the pot.

In an advantageous embodiment an opening is provided, viewed in the axial direction of the pot, approximately in the middle of the pot. The removal of heat produced inside the pot is possible through this opening. As a result thereof, the temperature inside the pot is in an advantageous range in which on the one hand it becomes possible to draw the thread smoothly off the spool and to achieve a good service life of the individual components.

If the layer is arranged at least partially on the inner circumference of the pot an economical manufacture of the pot can be achieved. The layer, which can be very cost-intensive, is limited to the zones inside the pot by this advantageous embodiment in which it can make its qualities completely effective. This is in particular at the locations at which the thread balloon is limited by the pot and thus the yarn makes contact with the pot. It can therefore also be advantageous if the layer is arranged at least only partially in the axial direction on the inside of the pot. The transitional zones of the individual pot halves can be particularly susceptible to wear in a devidable pot and therefore require special protection against wear at these positions.

It is especially advantageous and in many instances sufficient if the layer is arranged at least in the area of the inner circumference of the pot in which the drawing-off yarn has contact with the pot or the layer. The pot is mechanically and/or thermally stressed at these positions, for which reason it is advantageous if these positions are provided with the layer or the pot insert which is appropriately coated or consists totally of the wear-resistant material.

In many instances it is sufficient and also advantageous if the base body consists of plastic. In this instance the base body of the pot can be manufactured in a simple and economical manner. Particularly high demands should not be placed on the wear resistance of the base body since it is coated in accordance with the invention at the decisive positions. The layer assumes the function of wear resistance in a mechanical as well as in a thermal regard and reduces in this manner the requirements placed on the base body. As an alternative, a base body consisting of aluminum also offers advantages in individual applications.

It is especially advantageous in a few applications if the layer and/or the pot consist/consists of noble steel or aluminum, especially hard-coated aluminum or of plastic which is mechanically and/or thermally wear-resistant and/or with low friction, in particular PTFE embedded in a carrier material. Noble steel can assure cooperation with a few of the winding threads used, consisting of synthetic material or natural yarns, for especially good frictional conditions. In addition, it is very malleable and can therefore be readily joined to the base body of the pot or used for the pot in its entirety. The described layers of aluminum or plastic offer advantages for individual applications, in particular for the processing of certain threads.

If the layer is manufactured from chromium, nickel or ceramic material an especially high wear resistance is assured. These materials can be applied either as a layer onto the base body of the pot or can be designed as a pot insert as a solid body.

Novel, mechanically and/or thermally wear-resistant plastics can also be used in an advantageous manner as a layer on the base body or as pot insert or as materials embedded in the layer. In such instances of application the base body can be manufactured from a plastic that is simple as regards its mechanical and/or thermal qualities whereas the stressed parts consist of high-quality plastic.

In order to achieve an especially good friction and therewith a good runoff quality of the thread on the surface of the layer it is advantageous if the layer is structured. Thus, e.g., an orange-peel [pitted, pinholing] structure or a corrugated, impressed, structured or abrasive-blasted surface is advantageous, depending on the winding thread and the production speed used.

It is also particularly advantageous in some applications if the surface of the layer is polished. This achieves especially good contact qualities between the thread and the layer. It can be advantageous if the surface is polished with a brush, brush-polished and wobbled or chemically polished.

If the layer of the invention is a thin application on a background it is advantageous if the surface of the pot insert is coated with this layer. A plasma coating can also be considered in individual instances of use.

If the thin layer of the pot insert consists of chromium, nickel or ceramic material the pot insert itself can be manufactured from a material less subject to mechanical and/or thermal wear and the required properties are taken over from the chromium, nickel or ceramic material of the layer.

The pot insert can also be used in an especially advantageous manner as an adapter for different spool diameters. Varying the thickness of the pot insert makes it possible to use different spool diameters in such a manner that the interval of the inner circumference of the pot is essentially constant independently of the spool diameter used. Thus, in the case of rather small spool diameters a rather thick pot insert can be selected whereas in the case of rather large spool diameters a rather thin pot insert can be used. In this manner the interval of the inside of the pot insert from the spool and the spool plate can be maintained essentially constant as a result of which the constriction of the thread balloon is influenced in an advantageous manner. This makes higher draw-off speeds possible.

It is advantageous in particular for thin pot inserts or layers if a spacer ring is provided that bridges the space between the pot and the layer or the pot insert and thus makes it possible for the pot to be used for different spool diameters.

In order to be able to use different spool lengths in the same pot it is advantageous if the pot insert is designed in such a manner that it shortens the inner chamber of the pot in the axial direction. This makes possible an extremely variable use of the present invention.

Pot inserts can therefore be used that act in the axial direction or in the radial direction of the pot. A different requirement is placed on the pot insert responsible for the axial shortening of the pot than is placed on the part of the axial pot insert. It can therefore be advantageous if the part for the axial shortening of the pot has different material properties than the part of the pot insert acting in the radial direction. The axial part of the pot insert does not have to be designed to be wear-resistant, so that simple materials can be used for it.

It is possible, by means of a special designing of the inner chamber of the pot, to basically determine in advance the direction of the air flow in the pot. It is therefore particularly advantageous if the pot insert is shaped in such a manner that it influences the air flow in the pot. In particular, a conical design of the pot insert proved to be advantageous in this connection. It is even possible, by arranging the conicity at determined positions of the pot insert, to effect the air flow in different axial directions of the pot.

In order to make the functioning of the pot insert effective in an especially advantageous manner the pot insert should closely surround the spool, especially its spool plate. All that is required thereby is a slot through which the winding thread can be drawn off during operation. On account of this narrow slot the friction of the thread on the pot is especially high and the invention especially effective.

If at least one spacer ring is arranged between the pot and the pot insert and if the spacer ring is replaceable different pot heights and spool heights can be compensated by using different spacer rings. The overall height of the device can then be adjusted relative to the height of the hollow shaft or can also remain unchanged as required.

Further advantages of the invention are explained in the following description of exemplary embodiments.

Figure 1:
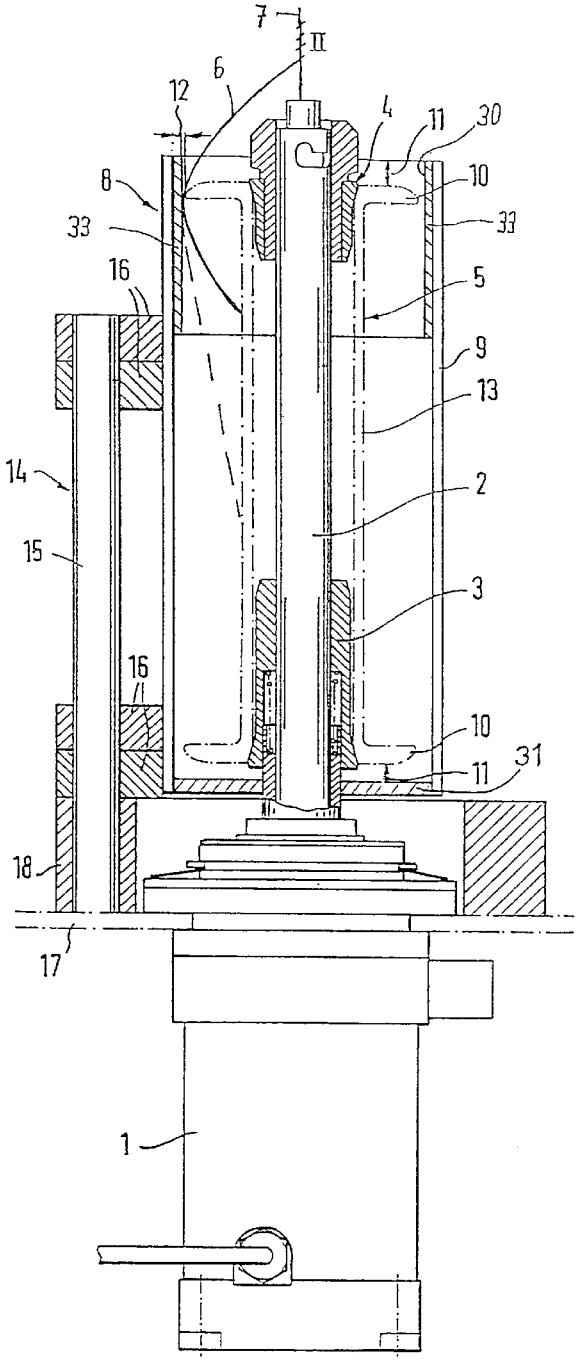
FIG. 1 shows a lateral view of a winding spindle.

FIG. 1 shows the device for manufacturing covered yarn in a sectional lateral view. A winding spindle consists of hollow shaft 2 driven by drive motor 1. Drive motor 1 raises the winding spindle to speeds of over 30,000 rpm. Spool entrainer 3 and adapter 4 are arranged on hollow shaft 2 between which devices 3 and 4 spool 5 is arranged in such a manner that it can be replaced by another spool as required. Other spools 5 can have different diameters and different axial lengths.

Spool 5 is frictionally or positively connected to the spool entrainer and adapter 4 and therewith to driven hollow shaft 2 so that the rotation of hollow shaft 2 is transferred to spool 5.

Indicated winding 13 is located on spool 5 which winding contains sheath thread 6. Sheath thread 6 is drawn off from spool 5, drawn off around core thread. 7, which is supplied through hollow shaft 2, and wound around core thread 7 by the rotation of spool 5. A balloon-shaped formation of sheath thread 6 is produced during the drawing off of sheath thread 6 by centrifugal force. This thread balloon is limited by pot 8. Pot 8 is arranged at distance 12 from spool plate 10 of spool 5 around spool 5. In addition, pot 8 has a certain axial projecting length 11 in order to assure a smooth drawing off of sheath thread 6 as well as favorable flow conditions. In addition to limiting the thread balloon of sheath thread 6 pot 8 brings it about that sheath thread 6 and the covered yarn being produced are protected from contamination, no or little turbulence is produced in the vicinity of sheath thread 6 and that a high-quality winding thread can thus be produced.

Interval 12 between pot 8 and spool plate 10 is to be dimensioned in such a manner that sheath thread 6 can be drawn off through this annular opening without any problem, e.g., a thread breakage occurring.

Pot 8 is arranged coaxially around spool 5 and spool plate 10. In the exemplary embodiment of FIG. 1 pot 8 is divided in the axial direction of spool 5. The two halves of pot 8 can be removed from one another by means of hinge joint 14. It is possible to replace spool 5 as required in a simple manner through this opening of pot 8. Spool 5 is quite assessable through the opened pot and can thus be replaced in a very simple manner. In addition, it is especially advantageous to take up a torn sheath thread 6 again and restart the thread manufacturing process.

Hinge joint 14 consists of shaft 15 and fastenings 16, each of which fastenings 16 is connected to a half shell of pot 8. Fastenings 16 are arranged in such a manner that they can rotate about shaft 15 so that the pot halves of pot 8 can be removed from one another.

Spacer ring 18 is arranged between pot 8 and housing 17 of the spinning winding device. Spacer ring 18 brings it about that pot 8 has a predetermined interval from housing 17 and thus makes it possible to mount hollow shaft 2. Spacer ring 18 can be advantageously designed in such a manner that it comprises flow openings through which the air flow penetrating into pot 8 can exit again out of pot 8 in a predetermined manner. This flow, which can be predetermined, produces a defined and advantageous flow of air in pot 8. This produces on the one hand a cooling of pot 8 and on the other hand a rotation of spool 5 which conserves energy, as only a slight amount of pneumatic friction is involved, and the drawing off of sheath thread 6 are brought about.

The use of different spacer rings 18 makes it possible to process different spools, in particular different spool heights. Since the path of the thread from the spool to the winding location is important for a good draw-off of the thread from the spool, different spool heights can be compensated from below by different spacer-ring heights and possibly different heights of pot 8. The same hollow shaft 2 can then be used.

Layer 30 is located on the inside of pot 8 on its draw-offend. Layer 30 is mechanically and/or thermally wear-resistant. Drawn-off sheath thread 6, which forms a thread balloon, contacts pot 8 and layer 30 in the area of layer 30. This contact produces a mechanical and thermal wear which layer 30 opposes. Layer 30 is limited axially in the present exemplary embodiment since there is generally a limited area on pot 8 on which the thread balloon of sheath thread 6 can make contact with pot 8. It is therefore sufficient in many instances to make an axially limited coating of pot 8.

Layer 30 can be made as a surface coating of pot 8. If pot 8 is manufactured from plastic, this plastic can be coated, e.g., with chromium or noble steel in order to obtain a wear resistance of the plastic at this position. Layer 30 can also consist of another, different plastic that is largely resistant to mechanical or thermal wear, just as the layer of chromium. In order to obtain a good thermal conductivity the base body of the pot can also be manufactured from aluminum.

Layer 30 can be a pot insert 31, 33 designed as a separate part and fastened to pot 8. Care is to be taken at the transition areas between pot insert 30, 33 and pot 8 that they are as free of burrs as possible in order that there is no danger of injuring sheath thread 6. It can be advantageous in this connection if the ends of pot insert 31, 33 are arranged in a lowered manner in pot 8 or at least comprise a phase for avoiding a chafing of sheath thread 6 on this edge.

Layer 30 can also comprise a specially formed surface, e.g., a surface similar to an orange peel. This influences the sliding property of sheath thread 6 on layer 30 in a particular advantageous manner since the friction is significantly reduced.

The concrete design of layer 30 is frequently a function of the type of sheath thread 6 as well as of the draw-off rate and the diameter of pot 8. Forces are produced on sheath thread 6 thereby that must be compensated by more or less intensive measures during the shaping of layer 30.

Axial pot insert 31 is arranged on the bottom of pot 8. The use of spools 5 with different lengths is made possible by axial pot insert 31. Lower projecting length 11, which should not exceed a certain given dimension in order not to adversely affect the air flow, can be adapted by axial pot insert 31 to an admissible dimension.

Therefore, axial pot inserts 31 with differing thicknesses can be used for different axial lengths of spool 5. It is possible therewith to retain essentially uniform flow conditions within pot 8 even when using different spools 5.

Figure 2:
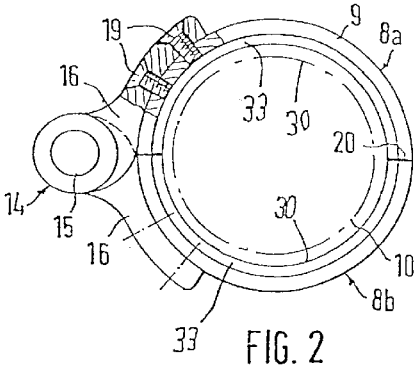
FIG. 2 shows a top view in axial direction onto a winding spindle of FIG. 1.

FIG. 2 shows a top view of a pot 8 with its pivotable fastening from FIG. 1. Fastenings 16 together was shaft 15 form hinge joint 14. One half 8*a,* 8*b* of pot 8 is fastened to each fastening 16 by screws. Halves 8*a,* 8*b* divide pot 8 in such a manner that the device is opened by means of a pivoting about shaft 15. Two butt seams 20 are produced between the two halves 8*a* and 8*b* in the closed state of pot 8. These butt seams 20 represent a critical point for the draw-off of sheath thread 6. Sheath thread 6, which is pulled through interval 12 between pot 8 and spool plate 12, slides over these butt seams 20. On the one hand sheath thread 6 can be damaged thereby and on the other hand elevated wear can be observed on butt seam 20 if it is not advantageously designed. It has therefore proven to be advantageous if butt seam 20 is designed to be lowered, that is, either layer 30 is designed thinner at the location of butt seam 20 than at the other locations so that a lowering of butt seam 20 is produced over which sheath thread 6 slides without problems. It is also possible that the side of layer 30 from which the sheath thread comes during its rotation is designed to be elevated in the manner of a ski jump [flip bucket] in comparison to the side of layer 30 onto which sheath thread 6 subsequently passes. Even in this manner sheath thread 6 jumps over the critical spot of butt seam 20, as a result of which any damage can be avoided.

Figure 3:
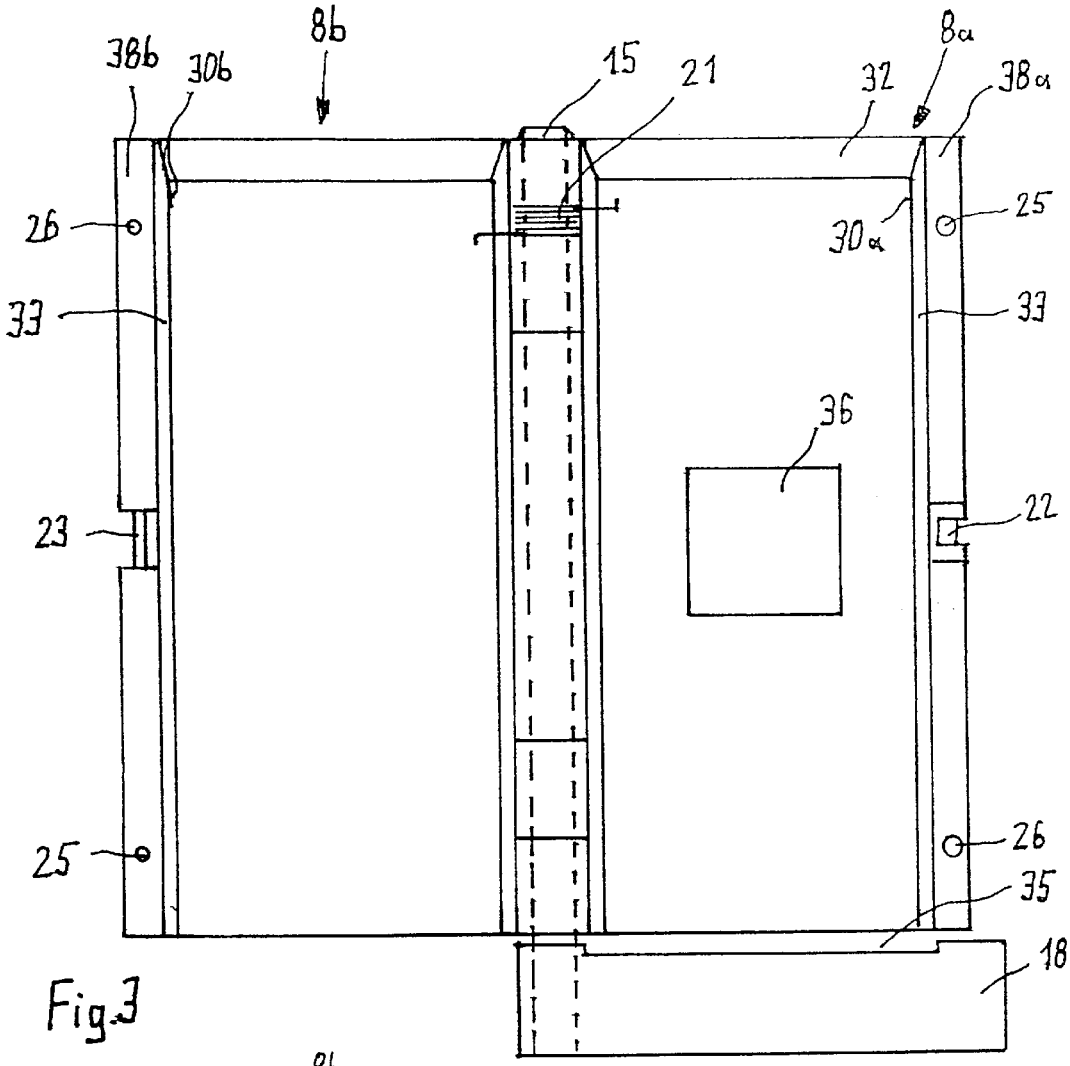
FIG. 3 shows a top view in axial direction onto an open pot.

FIG. 3 shows another exemplary embodiment of the present invention. Here pot 8 is again divided in an axial direction so that two pot halves 8*a* and 8*b* are present. Pot halves 8*a* and 8*b* are connected to each other via shaft 15 in such a manner that they can be moved away from one another for opening. One of the two halves of the pot, namely half 8*a,* is fastened to spacer ring 18. Thus, when pot 8 is opened, half 8*b* is pivoted away from half 8*a*. Spring 21 is provided in order to bring about a defined position and in particular a self-adjusting position of half 8*b*. It can be provided, as required, that spring 21 holds half 8*b* in open position in non-loaded position or it can be provided for reasons of safety that spring 21 assures that half 8*b* always pivots in the direction of half 8*a* when no further force counteracts the spring force.

Hook 22 is provided in half 8*a* for closing the two halves 8*a* and 8*b,* which hook cooperates with pin 23 of half 8*b*. If hook 22 and pin 23 are in mutual contact, pot 8 is closed. Half 8*b* can be rotated away from half 8*a* by actuating hook 22.

Another embodiment (not shown) is especially advantageous in which both halves 8*a* and 8*b* can rotate about shaft 15 and are therefore not fastened to the spacer ring. In this instance the operation of replacing the spool can be carried out in an especially simple manner.

In order to assure an exact positioning of halves 8*a* and 8*b* pins 25 and openings 26 corresponding to each other are provided. This centering device assures that halves 8*a* and 8*b* always stand in a predetermined position relative to each other in closed position. As a result, the predetermined flow conditions as well as in particular butt seams 20 are to be designed in such a manner that sheath thread 6 is not damaged.

Air gap 38 is provided in spacer ring 18, which gap is arranged on a part of the circumference of the lower axial end of the pot. Air drawn in on the upper end of pot 8 is removed in a purposeful manner through this air gap 35. A purposeful flowthrough [of air] through pot 8 can be achieved by an appropriate arrangement of air gap 35 on the circumference of pot 8 or of spacer ring 18 as well as on a certain cross section of the opening. In particular, air flowing out through air gap 35 can be used in a purposeful manner for cooling other units of the spinning winding device. The air can also be used to clean the spinning winding device if it is conducted to appropriate locations of the spinning device which are sensitive to contamination.

Figure 4:
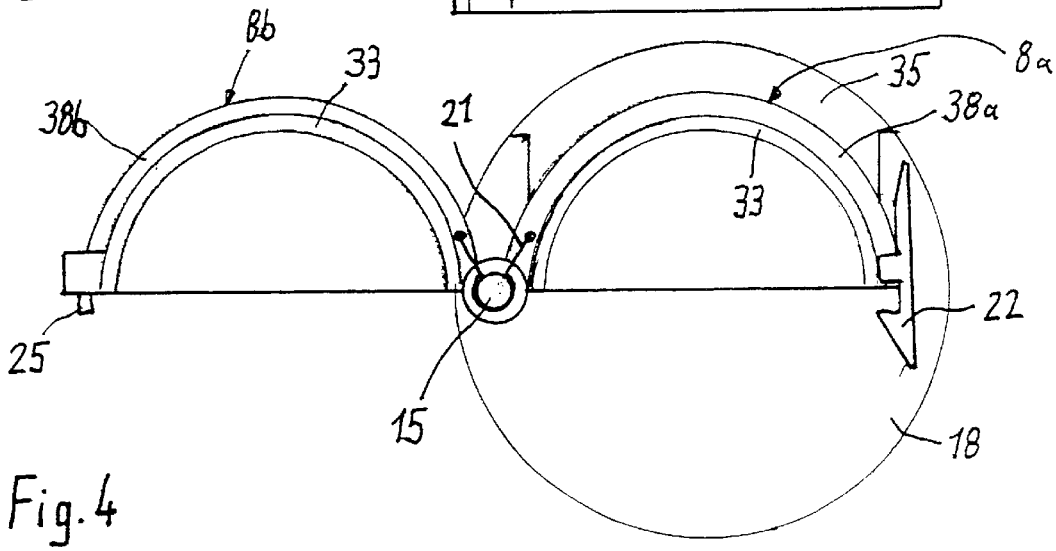
FIG. 4 shows a lateral view of an open pot of FIG. 3.

In the exemplary embodiment of FIGS. 3 and 4 layer 30 is massively designed as a pot insert. Each of halves 8*a* and 8*b* consists of a base body 38*a* and 38*b*. Layers 30*a* and 30*b* are arranged respectively in base body 38*a* and 38*b* as a pot insert. Pot insert 30*a,* 30*b* consists of a material that is mechanically and/or thermally wear-resistant. This material can be noble steel or appropriately developed plastics exhibiting the required properties. Pot insert 30*a* and 30*b* is arranged over the complete axial length of pot 8. This assures that even when the thread makes contact with pot 8 on lower areas of pot 8, e.g., in the case of a thread break, protection against wear is provided even here. In addition, if the pot is jacketed with layer 30 over its entire area an additional butt seam is avoided on which thread 6 could be damaged.

Top insert 33 with its layer 30*a,* 30*b* is provided on its upper end with conicity 32. Conicity 32 brings it about on the one hand that sheath thread 6, which is drawn off at this location, is protected from damage. On the other hand conicity 32 can advantageously affect the air flow passing into pot 8 and out of pot 8. It is even possible, as experiments have shown, that a reversal of the air flow is produced by changing conicity 32, in particular in conjunction with a changing of the opening of spacer ring 18. This surprising determination has a result that distinctly different air flows can be produced by different inserts 30*a,* 30*b*. This makes it possible to exert influence on special spinning conditions and to produce an optimal yarn with optimal running properties.

Opening 36 is provided in the central area of pot 8 and pot halves 8*a*. A good removal of heat out of pot 8 is assured by this opening 36. After it was determined that the pot exhibits an elevated warming in this area in particular during operation it proved to be especially advantageous to provide opening 36 here. This reliably avoids a backup of heat inside pot 8 since the backed-up heat can escape out of pot 8 through opening 36. Openings such as opening 36 shown can be arranged either in both halves or in individual halves. They can of course also be provided either multiply or in other sizes in an area different from the one shown here. Care must always be taken that the course of the thread is disturbed as little as possible by opening 36.

FIG. 4 shows a top view of the device of FIG. 3. Whereas pot half 8*a* is fastened permanently on spacer ring 18, pot half 8*b* can be pivoted away from pot half 8*a*. Shaft 15 functions as the axis of pivoting. Spring 21 assures that half 8*b* is held in a defined position, either open or closed, in the relaxed state of spring 21. Halves 8*a* and 8*b* are held in a predetermined position by centering pins 25 so that no unintentional impacts are produced on butt seams 20. In closed position halves 8*a* and 8*b* are held by hook 22 that cooperates with pin 23 of the other half 8*b*.

In order to be able to use different spool diameters with the same base bottom 38*a* and 38*b*, the use of layers 30*a*, 30*b* and pot inserts 33 with different thicknesses can be provided. Either pot insert 33 can be designed with different thicknesses or spacer pieces can be arranged between base body 38*a* and 38*b* and insert 33. This enables fairly large distances to be bridged, as a result of which interval 12 acts between the effectively acting inner wall of the pot and spool plate 10, and retained.

Figure 5:
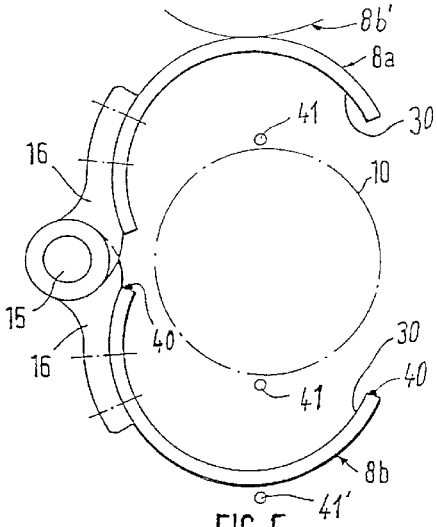
FIG. 5 shows a pot which can be opened on both sides.

FIG. 5 shows a pot 8 which can be opened on both sides. Pot halves 8*a* and 8*b* are deflected about shaft 15. Each pot half 8*a* or 8*b* is movably designed. In order to be able to concentrically surround a spool (not shown) stops 41 are provided fastened, e.g., to spacer ring 18 (not shown). Pot halves 8*a* and 8*b* can be brought into a maximum position of closure by means of stops 41. This produces a concentric annular slot between the spool plate and pot halves 8*a*, 8*b*. In addition, stops 41 function as a limitation for adjacent spools if their pot 8 has been removed, e.g., for maintenance. Stop 41' of the adjacent spinning position is arranged in such a manner that it functions as the outer stop for the pot half, here 8*b*. In as far as the adjacent spinning position is provided with a pot, e.g., here 8*b*', pot half 8*a* strikes against this pot half 8*b*' so that a limiting stop is also present here.

In order to close pot halves 8*a* and 8*b* tightly against one another, seal 40 is provided at joints 20. Seal 40 closes pot halves 8*a*, 8*b* in such a manner against one another that an air flow is avoided either from the inside of the pot to the outside of the pot or vice versa. This assures a a calm and problem-free course of the thread without disturbing or possibly contaminated foreign air.

The device is not limited to the exemplary embodiments shown. Thus, different types of divisions of pot 8, e.g., in the circumferential direction of the spool are of course conceivable. In this instance the spool can be made readily assessable by moving the pot halves axially apart. Even combined divisions in the horizontal and vertical directions of the pot with appropriate coatings can be considered as falling under the protection of the present invention. The invention with the coating on the inside of the pot can of course also be used in non-divided pots even if this has an adverse impact on the operation of the spool. Likewise, the layer does not have to be designed as a separate part of the pot or as a layer applied to a base body. Given a suitable selection of the material even the entire wall thickness of the pot can consist of the material of the layer in accordance with the invention.

What is claimed is:

1. An apparatus for producing covered yarn comprising:

a spinning pot having a top portion and a bottom portion, said bottom adapted for operatively engaging therein a rotating winding spindle supporting a spool having spool plates with winding thread positioned therebetween, said spinning pot further defining a first half and a second half, said first and second halves being reclosable between an open position and a closed position along an axially extending pivot; and, a removable insert positioned against an inner wall of a top portion of said spinning pot, said insert adapted for a spaced engagement opposite a spool plate, said insert further comprising a wear resistant material.

2. The apparatus according to claim 1 wherein said insert may be selected from a plurality of inserts having different insert thicknesses, said selected insert being based upon a function of the spool diameter.

3. In a device for manufacturing covered yarn in which one or more threads are wound in a helical fashion around a yarn core and having a rotating winding spindle with a spool on which winding thread is located and positioned within a spinning pot surrounding the winding spindle, the spinning pot divided into two halves along a geneatrix, wherein the improvement comprises that at least a portion of an inner radial wall of said spinning pot comprises a wear resistant insert that surrounds a portion of the spool.

4. The device according to claim 3 wherein the wear resistant insert is positioned a spaced distance from a spool plate defined by the spool.

5. The device according to claim 3 wherein said two halves engage a hinge wherein a first pot half and a second pot half can be moved away from the spool.

6. The device according to claim 3 wherein said wear resistant inserts further comprises a first insert portion and a second insert portion, said first and second insert portions positioned along opposite inner halves of said spinning pot.

7. The device according to claim 3 wherein said wear resistant inserts are selected from the group consisting of coated aluminum, wear resistant plastic, PTFE, chromium, nickel, ceramic, or combinations thereof.

8. The device according to claim 3 wherein a thickness of said wear resistant insert may be varied as a function of a diameter of said spool.

* * * * *